US011659328B2

(12) United States Patent
Klimanis

(10) Patent No.: US 11,659,328 B2
(45) **Date of Patent: *May 23, 2023**

(54) WEARABLE AUDIO DEVICE HAVING IMPROVED OUTPUT

(71) Applicant: Knowles Electronics, LLC, Itasca, IL (US)

(72) Inventor: Gints Klimanis, Cupertino, CA (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/722,364

(22) Filed: Apr. 17, 2022

(65) Prior Publication Data

US 2022/0240010 A1 Jul. 28, 2022

Related U.S. Application Data

(63) Continuation of application No. 17/079,370, filed on Oct. 23, 2020, now Pat. No. 11,337,000.

(51) Int. Cl.
*H04R 3/00* (2006.01)
*H04R 3/02* (2006.01)

(52) U.S. Cl.
CPC ..... *H04R 3/02* (2013.01)

(58) Field of Classification Search
CPC . H04R 3/00; H04R 3/005; H04R 3/02; H04R 3/04; H04R 3/10; H04R 25/00; H04R 25/45; H04R 25/48; H04R 1/08; H04R 2460/03; H04R 2460/13; H04R 2430/03
See application file for complete search history.

(56) References Cited

U.S. PATENT DOCUMENTS

| | | | | |
|---|---|---|---|---|
| 11,259,119 | B1 * | 2/2022 | Kim | H04R 3/04 |
| 11,337,000 | B1 * | 5/2022 | Klimanis | H04R 3/02 |
| 2009/0287485 | A1 * | 11/2009 | Glebe | G10L 15/20 455/575.1 |
| 2012/0278070 | A1 * | 11/2012 | Herve | H04R 3/005 704/226 |
| 2017/0171679 | A1 * | 6/2017 | Isberg | G06F 3/162 |

(Continued)

FOREIGN PATENT DOCUMENTS

WO WO-0021194 A1 * 4/2000 ..... H03G 3/301

*Primary Examiner* — Thang V Tran
(74) *Attorney, Agent, or Firm* — Loppnow & Chapa; Matthew C. Loppnow

(57) ABSTRACT

A wearable audio device can include a microphone located to detect atmospheric sound including a user's voice. The device can include an acoustic vibration sensor located to detect sound including the user's voice conducted through the user's body. The device can include a body voice filter coupled to the acoustic vibration sensor. The device can include a filter parameter generator coupled to the acoustic vibration sensor and the body voice filter the filter parameter generator configured to generate parameters for the body voice filter based on a frequency characteristic of a signal obtained from the acoustic vibration sensor. The device can include a composite signal generator coupled to the body voice filter and the microphone and configured to generate a composite voice signal based on a low band signal obtained predominately from the body voice filter and based on a high band signal obtained predominately from the microphone.

20 Claims, 3 Drawing Sheets

(56) References Cited

U.S. PATENT DOCUMENTS

| | | | | |
|---|---|---|---|---|
| 2018/0211648 | A1* | 7/2018 | Nagai | G07C 5/085 |
| 2020/0314565 | A1* | 10/2020 | Sigwanz | H04R 25/40 |
| 2021/0287674 | A1* | 9/2021 | Unruh | H04R 3/04 |

* cited by examiner

WEARABLE AUDIO DEVICE HAVING IMPROVED OUTPUT

TECHNICAL FIELD

The disclosure relates generally to wearable audio devices, for example, wireless earbuds, having improved audio output and electrical circuits therefor.

BACKGROUND

Wearable audio devices like earbuds now commonly include a microphone and an electrical circuit to capture the user's voice and generate a corresponding audio signal for communication to a host device like a mobile phone or other device paired with or otherwise connected to the wearable device. However, the audio signal generated by the wearable device may not be an accurate representation of the user's voice due to the microphone not being located directly in front of the user's mouth, the presence of environmental noise, and variability in coupling to the user's body (e.g., ear canal seal), among various other factors. The voice signal produced by such an audio signal may be characterized by poor tonal quality or color, known as timbre, and may sound too "tubby" from excessive low frequencies or too "nasally" from inadequate low frequencies, resulting in poor intelligibility. Thus audio devices worn on the user's body, e.g., in the ear, around the neck, etc., often require compensation to more accurately reproduce the user's voice.

The objects, features and advantages of the present disclosure will become more fully apparent to those of ordinary skill in the art upon careful consideration of the following Detailed Description and the appended claims in conjunction with the accompanying drawings described below.

DETAILED DESCRIPTION

The present disclosure pertains to a wearable audio device that detects acoustic signals of a user wearing the device and that generates a corresponding electrical audio signal for communication to a host device like a mobile phone or other device paired with or otherwise connected to the wearable device. A microphone is integrated with the wearable device and located to detect acoustic signals including noise and voice propagated through the atmosphere when the wearable device is worn by the user. A vibration sensor is integrated with the device and located to capture voice and body noises conducted through the user's body when the wearable device is worn by the user.

The wearable audio device can be a wired earbud, headset, over-the-ear headphones, True Wireless Stereo (TWS) earphones, or neckband, among other wearable audio devices including one or more outward-facing microphones that can detect atmospheric acoustic signals, or sounds, and one or more vibration sensors that can detect sounds conducted through the user's body.

Figure 1:
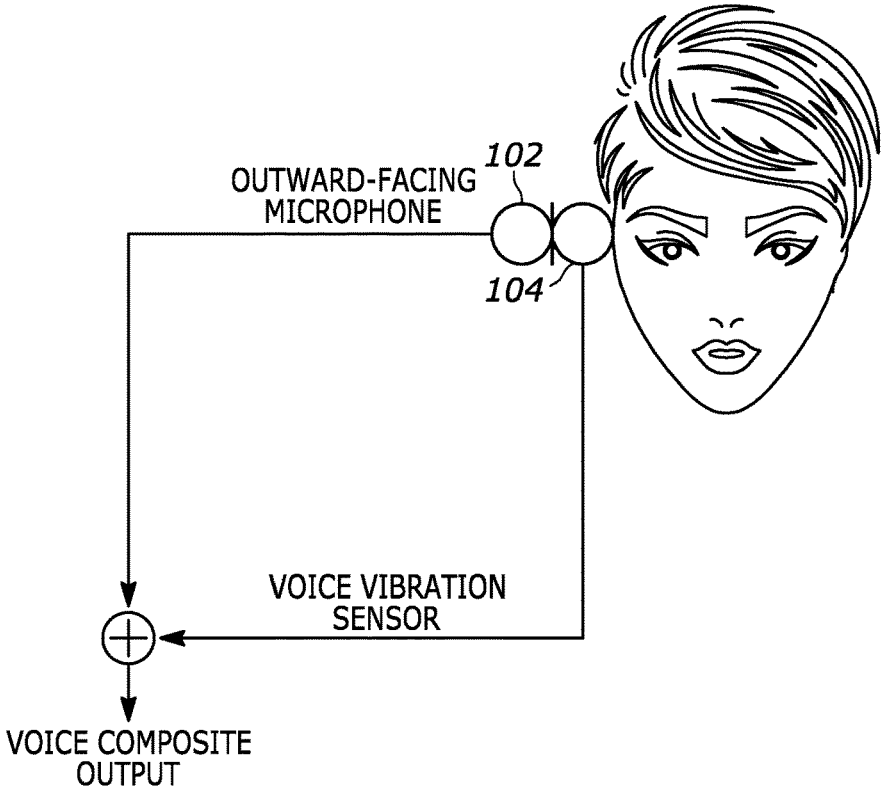
FIG. 1 is a schematic view of wearable audio device embodied as a hearable device wearable in or on a user's ear.
Figure 2:
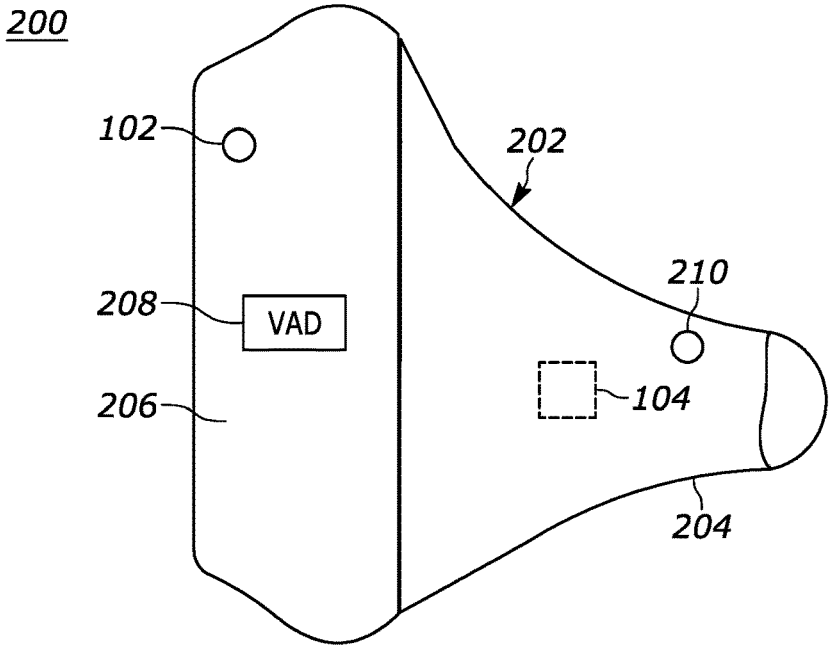
FIG. 2 is a more detailed view of the hearable device of FIG. 1.

In FIG. 1, the wearable audio device is configured with a microphone 102 and a vibration sensor 104 in proximity to the user's ear when the device is worn by the user. In this implementation, the microphone faces in an outwardly orientation to detect sounds propagated through the atmosphere. The vibration sensor is located where it can detect sounds conducted through the user's body. In FIG. 2, a hearable device 200 comprises a housing 202 having a stem portion 204 that fits partially in the user's ear canal and an outer portion 206 that is exposed to the atmosphere when worn by a user. The microphone 102 is integrated with the outer portion 206 of the housing where it can detect atmospheric noise and voice signals, and the vibration sensor 104 is integrated with a portion of the housing, like the stem 204, wherein it can detect voice and other sounds conducted through the user's body. A seal between the outer portion of the housing where the microphone is located and the stem portion where the vibration sensor is located when the device is worn by a user can improve isolation of the vibration sensor from sounds propagated through the atmosphere.

Figure 3:
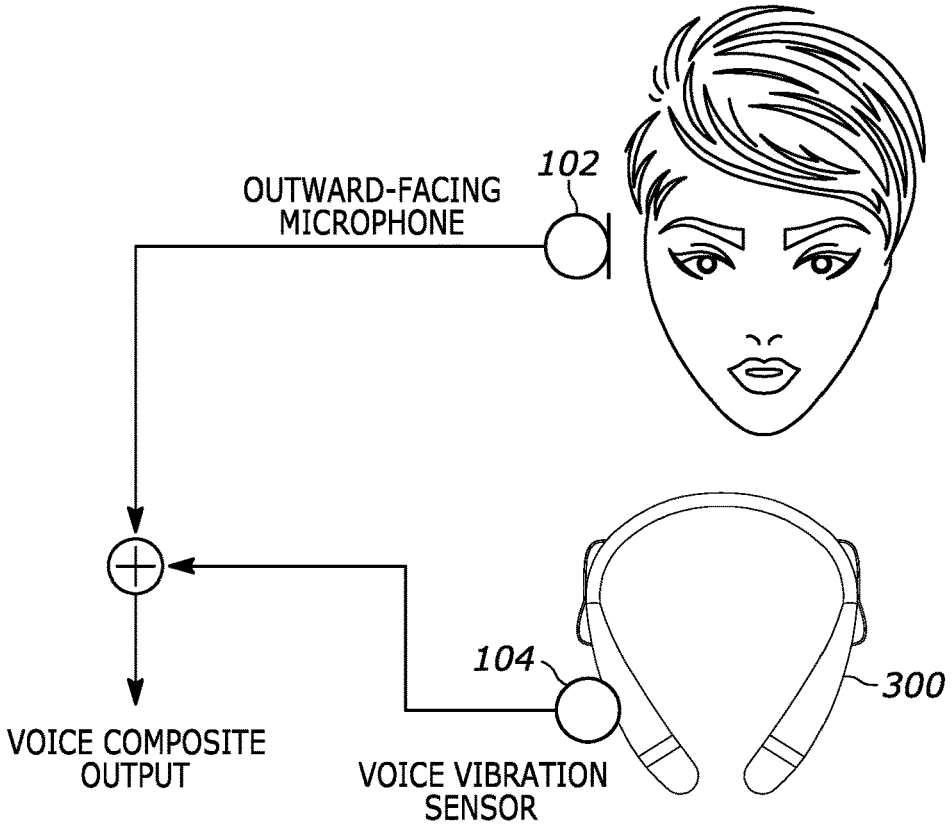
FIG. 3 is a wearable audio device embodied as a neckband.

In FIG. 3, the wearable audio device is configured as a neckband having a collar portion 300 with one or more earpieces electrically coupled to circuits in the neckband. The microphone 102 faces outwardly from one or both earpieces as shown. In an alternative implementation, the neckband is devoid of earpieces and the microphone is integrated in a portion of the collar 300 where the user's voice and other atmospheric sounds can be detected. In either implementation, the vibration sensor 104 is disposed on or sufficiently near a portion of the collar 300 where it can detect acoustic vibration conducted through the user's body.

Figure 4:
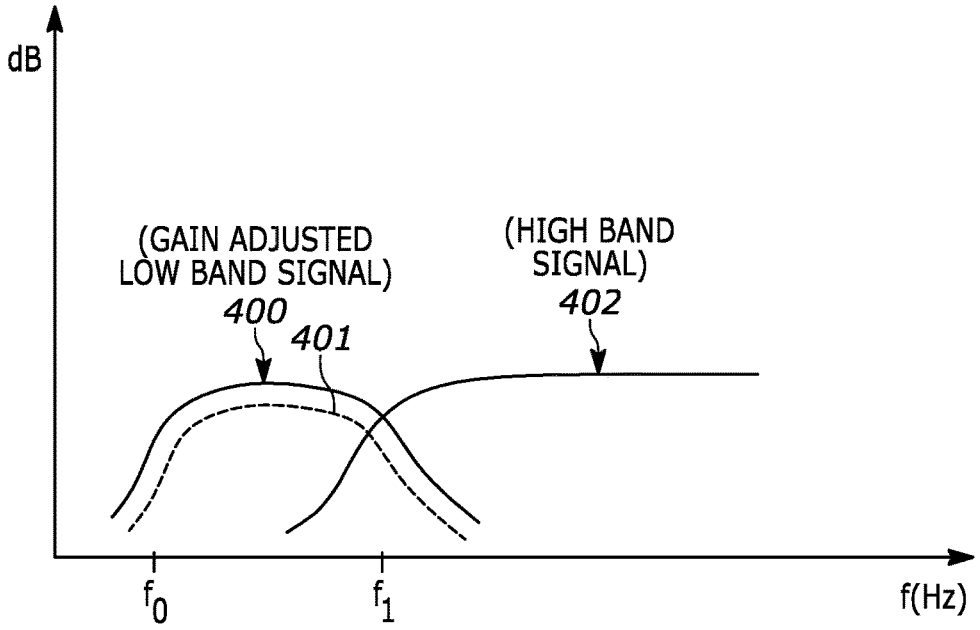
FIG. 4 is a gain versus frequency plot of a composite signal comprising a low band signal based on the vibration sensor signal and a high band signal based on the microphone signal.

According to one aspect of the disclosure, the wearable device generates a composite voice signal based on a low band signal and a high band signal. The composite voice signal is in the audio band and the "low" and "high" frequency band characterizations are relative terms. In FIG. 4, the composite signal comprises a low band signal 400 and a high band signal 402. The low band signal includes a component of the user's voice obtained from the acoustic vibration sensor and the high band signal includes a component of the user's voice obtained from the microphone. The low band signal is obtained predominately from the acoustic vibration sensor and the high band signal is obtained predominately from the microphone. The composite signal can be individualized for the user of the wearable audio device by selecting characteristics (e.g., bandwidth, cutoff frequency, slope, gain, etc.) of the low and high band signals based on one or more characteristics of a signal from the acoustic vibration sensor. The composite voice signal can be generated upon the occurrence of specified events and can also be adjusted by updating the low and high band signals from time to time based on changes in the characteristic of the acoustic vibration sensor signal.

Generally, characteristics of the low band signal are based on characteristics of a signal generated by the acoustic vibration sensor. Characteristics (e.g., low cutoff, slope . . . ) of the low band signal can be set to capture a first vocal (i.e., fundamental) frequency of the user. The first vocal frequency for adult humans is between approximately 60 Hz and approximately 220 Hz for an adult male. The first vocal frequency is typically about 80 Hz and approximately 165 Hz for an adult female. However, these ranges are only approximate as there is significant variability in human vocal frequencies. Also, the first vocal frequency for children may also lie outside these ranges. The low frequency f0 of the low band signal can also be set above low frequency noise conducted through the body. Body-conducted low frequency noise can be determined based on a spectral analysis of the vibration sensor signal, and the filter frequency f0 can be set or selected based on a noise level (e.g., energy or power) threshold. A high frequency f1 and filter roll-off slope of the low band signal can be determined based on a high or upper frequency edge and slope of a bandwidth of the signal output by the vibration sensor. The upper frequency edge and slope of the vibration sensor signal can be determined by a spectral analysis, and the high frequency f1 can be set or selected based on a signal level (e.g., energy or power) threshold. In FIG. 4, the low band signal has a low filter frequency f0 of 60 Hz and a high filter frequency f1 of 700 Hz, but these filter frequencies will be different for each user as suggested.

Characteristics of the high band signal are also based on characteristics of a signal generated by the acoustic vibration sensor. Characteristics (e.g., low cutoff, slope . . . ) of the high band signal can be set or selected based on the characteristics of the low band signal and to provide a composite signal devoid of significant ripples and other gain anomalies or processing artifacts that can adversely affect audio quality. Generally, the high filter frequency f1 of the low band signal and the low filter frequency of the high band signal can converge when the roll off slope is higher e.g., 24 dB/octave instead of 12 dB/octave. Conversely, the filter frequencies of the low and high band signals can diverge with decreasing slope. In one implementation, the low filter frequency of the high band signal is the same as the high filter frequency f1 of the low band signal. In FIG. 4, the high band signal 402 has a low filter frequency of 700 Hz, the same as the high filter frequency f1 of the low band signal 400. As suggested, however, the signal characteristics of the low and high band signals can be different. In other implementations, the high filter frequency f1 of the low band signal and low filter frequency of the high band signal are different. The crossover frequency is a frequency at which the low and high band signals intersect.

Figure 5:
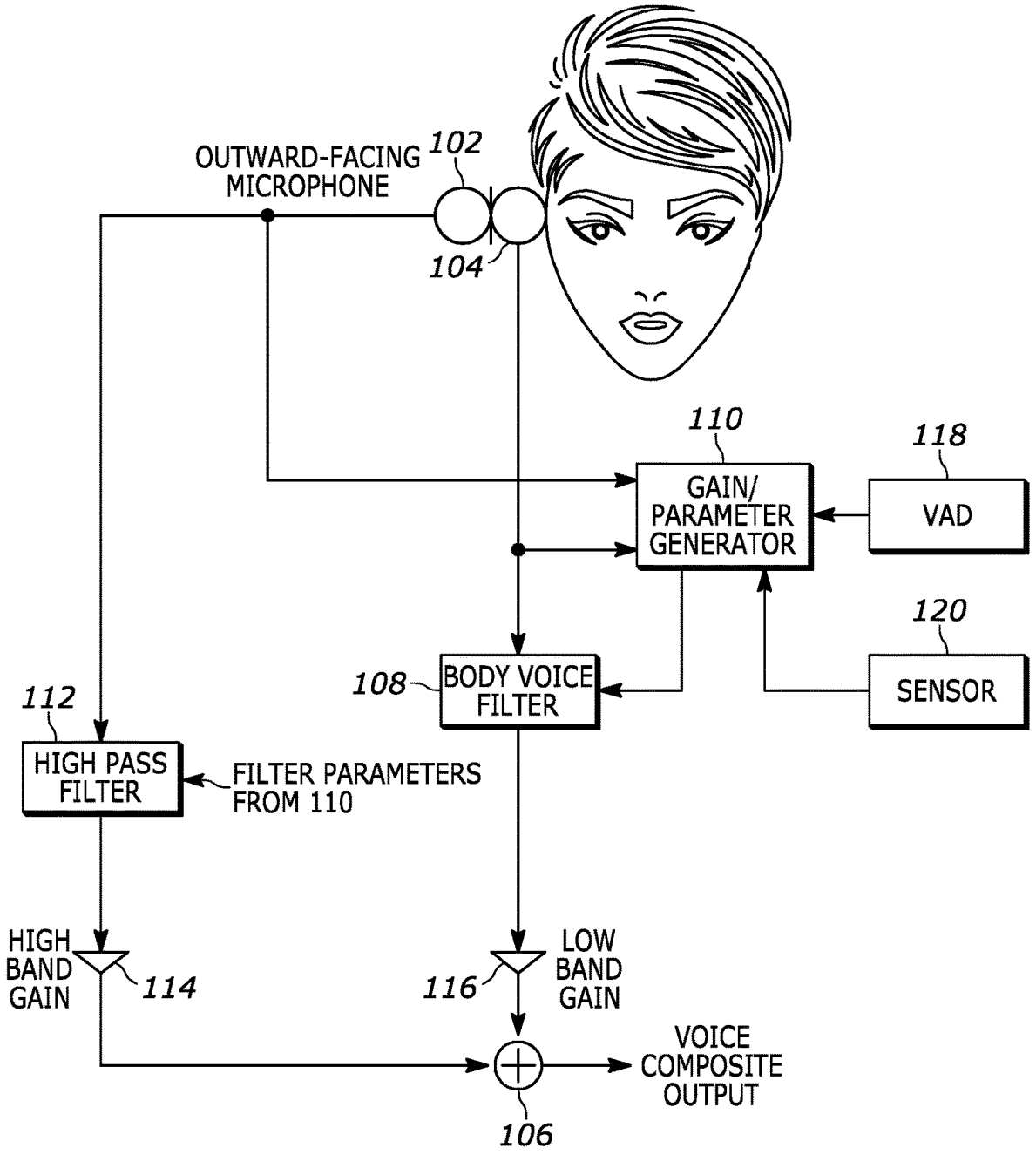
FIG. 5 is a more detailed block diagram of a wearable audio device according to one implementation.

In FIG. 5, the wearable audio device comprises a composite signal generator 106 coupled to the microphone 102 and to the vibration sensor 104. These and other couplings described herein are electrical signal couplings that enable the communication and processing of signals described herein. The composite signal generator is configured to generate the composite voice signal based on the low band signal obtained predominately from the acoustic vibration sensor and based on the high band signal obtained predominately from the microphone.

In FIG. 5, a body voice filter (BVF) 108 is disposed in a signal path between the acoustic vibration sensor 104 and the composite signal generator 106. A high pass filter 112 is disposed in a signal path between the microphone 102 and the composite signal generator. A filter parameter generator 110 is coupled to the acoustic vibration sensor 104, the body voice filter 108, and the high pass filter 112. In one implementation, the low and high bands are defined by $4^{th}$ order filters.

The filter parameter generator is configured to generate parameters for the body voice filter and the high pass filter based on signals from the acoustic vibration sensor as described herein. The filter parameters include cutoff frequencies, order/slope, quality factor Q, and gain. The filter parameter generator can be implemented as code executed by a processor that dynamically produces filter coefficients using an algorithm or that obtains the filter parameters by reference to a look-up table storing pre-calculated coefficients. The filter parameter generator generates low and high cutoff frequencies, slope and gain for the body voice filter 108. The filter parameter generator also generates parameters for the high pass filter 112. The filter parameters thus dictate the crossover frequency between the low and high band signals. When configured with parameters from the filter parameter generator, the body voice filter outputs the low band signal based on a signal including a component of the user's voice obtained from the vibration sensor and the high pass filter outputs the high band signal based on a signal containing a component of the user's voice from the microphone. The low band signal effectively is substituted for low frequency microphone signals attenuated by the high pass filter, thereby eliminating low frequency atmospheric noise detected by the microphone. Thus configured, the composite voice signal is based on a low band signal obtained predominately from the body voice filter and based on a high band signal obtained predominately from the high pass filter.

The wearable audio device can be configured to generate or update characteristics of the low and high band signals from time to time by updating the parameters for the body voice filter and the high pass filter. The filter parameters can be updated continuously or intermittently based on changes in one or more characteristics of the vibration sensor signal. Such changes in the acoustic vibration sensor signal may be result from changes in the user's voice due to fatigue or changes in emotion, humidity, temperature, etc. The occurrence of other events may also prompt generation of, or updates to, the filter parameters. Such other events include power ON, insertion of a hearable device in a user's ear, changes in the position or fitting (e.g., seal with the user's ear canal) of the wearable audio device, environmental conditions, etc. Conversely, generation or updates to the parameters may be suspended upon the occurrence of certain other events, like environmental noise exceeding a predefined threshold, among others.

According to another aspect of the disclosure, the wearable audio device includes voice activity detection (VAD) functionality and the wearable audio device is configured to generate or update the low band signal and the high band signal only upon determination that a user wearing the wearable audio device is speaking. As such, the filter parameter generator generates parameters based on one or more characteristics of the vibration sensor signal obtained while the user is speaking. In FIG. 5, a voice activity detector 118 is coupled to the filter parameter generator 110 or this purpose. A determination that the user is speaking can be made based on correlation among signals from the voice activity detector, the acoustic vibration sensor or the microphone. For example, the concurrent detection of signals from the VAD and one or both of the microphone and vibration sensor can support a conclusion that the user is speaking. Greater certainty can be attained by further processing e.g., spectral analysis of, the signals prior to correlating. Such further processing can include noise versus speech discrimination, word or speech detection, authentication, etc. These analyses and correlations can be performed by a processor performing the filter parameter generation. FIG. 2 shows a voice activity detector 208 integrated with the hearable device 200. The use of a VAD can reduce the collection of data to periods during which there is a high or at least a greater likelihood that the user is speaking and can eliminate or reduce unnecessary power consumption.

According to another aspect of the disclosure, the wearable audio device is configured to adjust the composite signal can by controlling a gain of the low band signal or the high band signal. For example, the gain of the low and high band signals can be equalized. The filter parameter generator can be configured to generate a time-variant gain for the low band signal or the high band signal based on the signal from the microphone. In FIG. 5, a low band gain parameter can be provided to the body voice filter 108. Alternatively, the filter parameter generator can be coupled to, and configured to generate gain control signals for, a high band gain amplifier 114 or a low band gain amplifier 116. In one implementation, the filter parameter generator is coupled to the microphone and configured to generate a gain for the low band signal based on a ratio of energy in low and high band portions of the microphone signal, wherein a portion of the low microphone signal corresponds to the bandwidth of the low band signal of the body voice filter. In FIG. 4, a gain of the low band signal 400 is increased from a lower level 401 for parity with the high gain signal 402. More generally, the filter parameters can be generated to produce any desired output response across the corresponding passbands of the low and high band signals. Thus configured, the low or high band signals can be adjusted or equalized to balance contributions to the composite signal. Gain control can be implemented anytime the filter parameters are updated.

In some implementations, the wearable audio device further comprises a sensor configure to sense when the wearable audio device is worn on or by the user. According to another aspect of the disclosure, the wearable audio device is configured to generate or update the low band signal and the high band signal only when the wearable audio device is being worn by the user. In FIG. 5, a sensor 120 is coupled to the filter parameter generator 110 for this purpose. FIG. 2 shows a sensor 210 integrated with the stem portion 204 of the hearable device where it can detect when the hearable device is inserted into, or placed on, the user's ear. The sensor can be an LED, infrared or other sensor capable of detecting proximity, temperature, heat rate or some other biological condition indicating that the wearable audio device is being worn by the user. The filter parameter generator can be coupled to the sensor and the filter parameter generator can be configured to generate or update parameters depending on whether the wearable audio device is being worn as indicated by the sensor. Thus, for example the low and high band signals can be generated initially when a hearable device is inserted into the user's ear. Thereafter, the low and high band signals can be updated from time to time based on changes in the characteristics of the signal from the vibration sensor.

While the present disclosure and what is presently considered to be the best mode thereof has been described in a manner establishing possession by the inventors and enabling those of ordinary skill in the art to make and use the same, it will be understood and appreciated that equivalents of the exemplary embodiments disclosed herein exist, and that myriad modifications and variations may be made thereto, within the scope and spirit of the disclosure, which is to be limited not by the exemplary embodiments described, but by the appended claims.

What is claimed is:

1. A wearable audio device comprising:

a microphone located to detect atmospheric sound including a user's voice when the wearable audio device is worn by the user;

an acoustic vibration sensor located to detect the user's voice conducted through the user's body when the wearable audio device is worn by the user;

a body voice filter coupled to the acoustic vibration sensor;

a filter parameter generator coupled to the acoustic vibration sensor and the body voice filter, the filter parameter generator configured to generate parameters for the body voice filter based on a frequency characteristic of a signal obtained from the acoustic vibration sensor; and a composite signal generator coupled to the body voice filter and the microphone and configured to generate a composite voice signal based on a low band signal obtained predominately from the body voice filter and based on a high band signal obtained predominately from the microphone, wherein the frequency parameter generator is configured to generate a crossover frequency of the low band signal and the high band signal from time to time based on a change in the frequency characteristic of the signal obtained from the acoustic vibration sensor.

2. The device of claim 1, wherein a high filter frequency f1 of the low band signal is at a high frequency edge of a signal bandwidth of the acoustic vibration sensor.

3. The device of claim 2, wherein a low filter frequency f0 of the low band signal is at a first vocal frequency of the user.

4. The device of claim 2, wherein the high filter frequency f1 of the low band signal is the same as a low filter frequency f0 of the high band signal.

5. The device of claim 1, wherein the filter parameter generator is coupled to the microphone and configured to generate a gain for the low band signal based on a ratio of energy in a low band portion and a high band portion of the signal from the microphone, wherein a bandwidth of the low band portion of the signal from the microphone corresponds to a bandwidth of the low band signal.

6. The device of claim 1 further comprising a voice activity detector, wherein the filter parameter generator is configured to generate parameters for the body voice filter only upon determination that a user wearing the wearable audio device is speaking based on correlation among signals from the microphone, acoustic vibration sensor and the voice activity detector.

7. The device of claim 1 is a hearable device comprising a portion configured for at least partial insertion into the user's ear and another portion exposed to the atmosphere when the hearable device is worn by the user, wherein the acoustic vibration sensor is integrated with the portion configured for at least partial insertion into the user's ear and the microphone is integrated with the portion exposed to the atmosphere.

8. The device of claim 7 further comprising a sensor integrated with the hearable device and configured to sense when the hearable device is worn by the user, wherein the filter parameter generator is configured to generate or update parameters for the body voice filter upon detecting that the hearable device is being worn by the user.

9. A wearable audio device comprising:

a microphone located to detect sound, including a user's voice, when the wearable audio device is worn by the user;

an acoustic vibration sensor located to detect the user's voice, conducted through the user's body when the wearable audio device is worn by the user; and a composite signal generator coupled to the microphone and to the acoustic vibration sensor, the composite signal generator configured to generate a composite voice signal based on a low band signal and a high band signal, wherein the low band signal is obtained predominately from the acoustic vibration sensor and the high band signal is obtained predominately from the microphone, and wherein the low band signal and the high band signal are based on a characteristic of a signal from the microphone, wherein a high filter frequency f1 of the low band signal is at a high frequency edge of a signal bandwidth of the acoustic vibration sensor and a low filter frequency f0 of the low band signal captures a first vocal frequency of the user.

10. The device of claim 9, wherein the wearable audio device is configured to adjust characteristics of the low band signal and the high band signal from time to time based on a change in the characteristic of the signal from the microphone.

11. The device of claim 9, wherein the high filter frequency f1 of the low band signal is the same as a low filter frequency f0 of the high band signal.

12. The device of claim 9 further comprising a voice activity detector, wherein the wearable audio device is configured to select characteristics of the low band signal and the high band signal only upon determination that a user wearing the wearable audio device is speaking based on correlation among signals from the voice activity detector and the acoustic vibration sensor.

13. The device of claim 9 further comprising a sensor configured to sense when the wearable audio device is worn on the user, wherein the wearable audio device is configured to generate or update the low band signal and the high band signal only when the wearable audio device is being worn by the user.

14. The device of claim 9, wherein the wearable audio device equalizes a gain of the low band signal and a gain of the high band signal.

15. The device of claim 9 further comprising:

a body voice filter in a signal path between the acoustic vibration sensor and the composite signal generator;

a high pass filter in a signal path between the microphone and the composite signal generator; and a filter parameter generator coupled to the acoustic vibration sensor, the body voice filter, and the high pass filter, the filter parameter generator configured to generate parameters for the body voice filter and the high pass filter based on a frequency characteristic of the signal output by the microphone, wherein the body voice filter configured with parameters from the filter parameter generator generates the low band signal based on a signal obtained from the vibration sensor, and wherein the high pass filter configured with parameters from the filter parameter generator generates the high band signal based on a signal obtained from the microphone.

16. The device of claim 15, the filter parameter generator coupled to the microphone, wherein the filter parameter generator is configured to generate a time-variant gain for the low band signal or the high band signal based on the signal from the microphone.

17. The device of claim 9 further comprising a housing including a portion configured for at least partial insertion into the user's ear and another portion exposed to the atmosphere when the wearable audio device is worn by the user, wherein the acoustic vibration sensor is integrated with the portion of the housing configured for at least partial insertion into the user's ear and the microphone is integrated with the portion of the housing exposed to the atmosphere.

18. A wearable audio device comprising:

a microphone located to detect sound, including a user's voice, when the wearable audio device is worn by the user;

an acoustic vibration sensor located to detect the user's voice, conducted through the user's body when the wearable audio device is worn by the user; and a composite signal generator coupled to the microphone and to the acoustic vibration sensor, the composite signal generator configured to generate a composite voice signal based on a low band signal and a high band signal, wherein the low band signal is obtained predominately from the acoustic vibration sensor and the high band signal is obtained predominately from the microphone, and wherein the wearable audio device equalizes a gain of the low band signal, wherein a high filter frequency f1 of the low band signal is at a high frequency edge of a signal bandwidth of the acoustic vibration sensor.

19. The device of claim 18, wherein a low filter frequency f0 of the low band signal is at a first vocal frequency of the user.

20. The device of claim 18 is a hearable device comprising a portion configured for at least partial insertion into the user's ear and another portion exposed to the atmosphere when the hearable device is worn by the user, wherein the acoustic vibration sensor is integrated with the portion configured for at least partial insertion into the user's ear and the microphone is integrated with the portion exposed to the atmosphere.

* * * * *